US008574035B2

(12) United States Patent
Schneider et al.

(10) Patent No.: US 8,574,035 B2
(45) Date of Patent: Nov. 5, 2013

(54) POLISHING DEVICE WITH ROTARY JOINT

(75) Inventors: Gunter Schneider, Marburg (DE); Helwig Buchenauer, Dautphetal-Buchenau (DE); Klaus Krämer, Dautphetal-Friedensdorf (DE); Ulf Börner, Marburg (DE)

(73) Assignee: Schneider GmbH & Co. KG, Fronhausen (DE)

( * ) Notice: Subject to any disclaimer, the term of this patent is extended or adjusted under 35 U.S.C. 154(b) by 847 days.

(21) Appl. No.: 12/653,032

(22) Filed: Dec. 7, 2009

(65) Prior Publication Data

US 2010/0159809 A1 Jun. 24, 2010

(30) Foreign Application Priority Data

Dec. 10, 2008 (DE) ..... 10 2008 061 267

(51) Int. Cl.
*B24B 41/053* (2006.01)

(52) U.S. Cl.
USPC ..... 451/259; 451/277

(58) Field of Classification Search
USPC ..... 451/28, 42, 60, 259, 277
See application file for complete search history.

(56) References Cited

U.S. PATENT DOCUMENTS

| | | | | |
|---|---|---|---|---|
| 5,255,474 | A * | 10/1993 | Gawa et al. | 451/295 |
| 5,498,163 | A * | 3/1996 | Takamura et al. | 439/13 |
| 6,234,815 | B1 * | 5/2001 | Omiya et al. | 439/191 |
| 6,290,583 | B1 * | 9/2001 | Suzuki et al. | 451/288 |
| 6,409,585 | B1 * | 6/2002 | Oowada | 451/364 |
| 7,255,628 | B2 * | 8/2007 | Kuebler et al. | 451/5 |
| 7,338,346 | B2 * | 3/2008 | Kuebler et al. | 451/5 |
| 7,458,879 | B2 * | 12/2008 | Togawa | 451/8 |

FOREIGN PATENT DOCUMENTS

| | | | |
|---|---|---|---|
| DE | G 82 29 094.6 | U1 | 3/1983 |
| DE | 197 51 253 | C2 | 11/2001 |
| DE | 102 50 856 | A1 | 5/2004 |
| DE | 199 05 583 | B4 | 11/2004 |
| DE | 10 2004 062 319 | B3 | 3/2006 |
| DE | 10 2005 010 583 | A1 | 9/2006 |
| DE | 20 2008 002 502 | U1 | 9/2008 |
| EP | 1 698 432 | A3 | 9/2006 |
| EP | 1 711 311 | B2 | 5/2007 |

* cited by examiner

*Primary Examiner* — Maurina Rachuba
(74) *Attorney, Agent, or Firm* — Hudak, Shunk & Farine Co. LPA

(57) ABSTRACT

A polishing device for polishing optical lenses having a tiltable base part for directly or indirectly receiving a polishing plate, which base part is connected to a polishing spindle having an axis of rotation D in order to be rotationally driven, wherein a rotary joint for supplying a polishing agent is provided, which rotary joint is at least partly arranged opposite said polishing spindle, relative to the base part, and a coupling element is provided by means of which the rotary joint can be detachably push-fitted or clipped onto a polishing spindle. A method for polishing selected zones of aspherical lenses which are not rotationally symmetric using a polishing plate which is guided by a polishing spindle so as to be tiltable, wherein during polishing, a polishing agent is introduced between said polishing plate and the lens via a rotary joint arranged between said polishing spindle and said polishing plate.

13 Claims, 1 Drawing Sheet

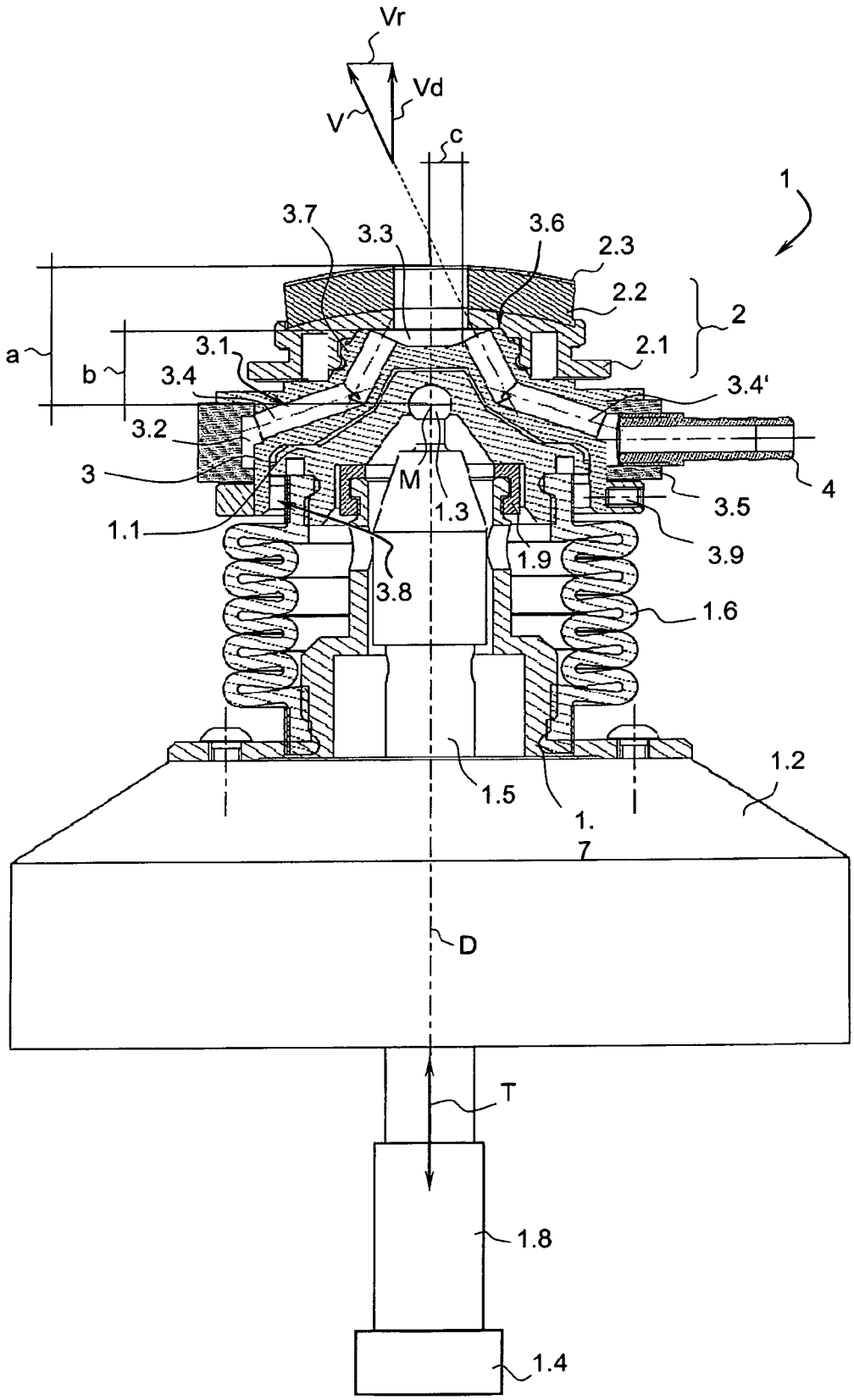
Vr
Vd
V
c
1
3.7
3.3
3.6
2.3
2.2
2
a
b
3.1
2.1
3.4
3.4'
3.2
3
M
1.3
4
3.5
1.1
3.9
1.9
3.8
1.6
1.2
1.5
1.
7
D
T
1.8
1.4

POLISHING DEVICE WITH ROTARY JOINT

FIELD OF THE INVENTION

The invention refers to a polishing device for polishing selected zones of optical lenses having a tiltable base part for directly or indirectly receiving a polishing plate, which base part is connected to a polishing spindle having an axis of rotation D in order to be rotationally driven.

Furthermore, the invention refers to a rotary joint for a polishing spindle for optical surfaces.

The invention also refers to a method for polishing selected zones of aspherical lenses which are not rotationally symmetric using a polishing plate which is guided by a polishing spindle so as to be tiltable.

BACKGROUND OF THE INVENTION

During the manufacture of aspherical lenses or lenses which are not rotationally symmetric, such as lenses having a toric surface or free-form surfaces, tools or polishing heads are normally used which are smaller than the lens surface to be machined, so called zonal polishing tools.

During the machining of selected zones, the tool or the polishing head is guided over the surface while a polishing agent is applied to those areas of the lens surface to be machined which are not covered by the tool, which polishing agent is then incorporated between the polishing tool and the lens surface to be machined, thus improving the polishing performance. To adapt the polishing head to the shape of the surface to be machined, the polishing head is mounted so as to be tiltable by means of a ball-and-socket joint. Furthermore, the polishing head comprises an elastic carrier layer for the polishing film so that the polishing head can be locally modified in shape for adaptation to the shape of the lens.

Such a polishing tool is known from DE 10 2004 062 319 B3. This publication describes a polishing device for optical lenses comprising a holder having an axis of rotation X and which is intended for attachment to a polishing machine, and a sleeve which is attached to said holder and serves to rotationally drive a tool holder or polishing head holder which is attached to said sleeve, which tool holder is guided so as to be tiltable by means of a guiding piston which is coaxially mounted in said holder and can be displaced in the direction of the axis of rotation X.

As mentioned above, the polishing agent is applied to the uncovered parts of the surface to be polished during machining of selected zones. An additional application of polishing agent is not necessary at first.

For machining spherical surfaces, especially in precision optics where mineral glass lenses are normally used, large polishing tools are used which cover the entire surface to be polished in order to obtain a highly precise spherical surface. The polishing agent cannot be supplied as described above in this case because the surface to be polished is not exposed during the polishing process. In this case, the polishing agent is advantageously supplied in a different way.

A device for supplying a polishing agent for precision machining of spherical surfaces is known from DE 199 05 583 B4. Said device comprises a cast shaping tool having a spherical machining surface for receiving a polishing film (not shown), and including a supply channel which is open towards the machining surface, and a rotatable connecting portion having a connection channel and by means of which the tool is detachably mounted. A supply part is connected to the connecting portion in the radial direction and can be rotated relative to said connecting portion, wherein there is sufficient play between the connecting portion and the supply part to ensure the leakage of auxiliary agents. The rotary joint created in this way is mounted on the outer circumference of a base part of the spindle and carries the polishing tool. Neither the rotary joint nor the polishing tool can be exchanged easily.

The relative angular position between the tool comprising the machining surface and the surface to be machined is fixed. Neither the tool nor the base part can be pivoted.

The polishing tool which is known from the state of the art is not designed as a polishing plate, but as a rigid casting to which a polishing film is attached. A polishing plate as used herein is characterized by a carrier part, usually made of plastic, to which an elastic foam layer is applied. Said foam layer serves as a carrier layer for a polishing film, which is preferably exchangeable and is also called polishing pad.

The elastic foam layer enables the polishing film to be adapted to the local conditions of the surface to be polished, in addition to the tilting movement of the polishing plate by means of the ball-and-socket joint. As explained, aspherical surfaces are mostly polished whose curvature varies in the radial direction as well as in the circumferential direction.

SUMMARY OF THE INVENTION

The object of the invention is to provide means for a polishing device for machining selected zones of surfaces which are not rotationally symmetric, which means ensure an improved supply of polishing agent.

According to the invention, this object is achieved by means of the features forth in the claims.

The use of a rotary joint for supplying a polishing agent, which rotary joint is at least partly arranged opposite the polishing spindle, relative to the axis of rotation D and relative to the base part, enables additional polishing agent to be supplied between a polishing head and a surface to be machined notwithstanding the use of a pivotable base part. The rotary joint and the polishing spindle or the ball-and-socket joint are thus arranged adjacent to the base part, relative to the axis of rotation D, so that the base part is placed between the polishing spindle or the ball-and-socket joint and the rotary joint, relative to the axis of rotation D.

The polishing spindle normally comprises a ball-and-socket joint by means of which the base part is mounted on the polishing spindle so as to be tiltable. The use of the rotary joint at the inventive position increases the distance between the ball-and-socket joint and a polishing head to be attached, which negatively affects the polishing behaviour at first. The passage of polishing agent in the area of the ball-and-socket joint or even in the area of the spindle is avoided, however.

The use of a coupling element by means of which the rotary joint can be detachably push-fitted or clipped onto a polishing spindle enables said rotary joint to be changed easily or even by machine for cleaning or washing. Such a change is not possible with the rotary joint known from the state of the art because this must be screwed to the spindle and the polishing tool in a rigid manner.

It can be advantageous in this context if the rotary joint comprises at least one polishing agent channel system having at least one supply opening and at least one outlet opening, wherein the outlet opening of the polishing agent channel system is at least partly arranged opposite the polishing spindle, relative to the base part. The rotary joint and the channel system or a hose connection for the transfer of polishing agent could also be separated in space. What is important in the end is that the polishing agent exits in front of the ball-and-socket joint or in front of the base part and is supplied to a polishing plate which is to be arranged there. The phrase "in front of" refers to the free side of the base part where the polishing plate and/or the rotary joint are arranged.

Furthermore, it can be advantageous if the supply opening of the polishing agent channel system is designed as an annular channel comprising several connection channels which are separated from each other and wherein the respective connection channel connects the annular channel to the outlet opening. The rotary joint known from the state of the art also comprises a polishing agent channel system having several connection channels. These connection channels, however, do not have the aforesaid feature, to the extent they are separated from each other, because they do not connect the annular channel to the outlet opening, but lead from the annular channel to a shared central channel which finally conveys the polishing agent to the outlet opening. The use of connection channels which are completely separated from each other ensures a certain redundancy in case that one of said channels is blocked.

It can also be advantageous if the respective connection channel has a direction component Vd parallel to the axis of rotation D, wherein the respective connection channel is arranged at a distance c to said axis of rotation D, at least over a part of its length. Such a design of the respective connection channel ensures that polishing agent is supplied in the inventive area of the polishing spindle, i.e. in front of the ball-and-socket joint or in front of the base part, on the one hand and prevents the distance between the polishing plate holder and the ball-and-socket joint from being unnecessarily large on the other. Each of the connection channels has therefore a radial as well as an axial direction component Vd, Vr so that the overall result is a funnel-shaped polishing agent channel system.

Advantageously, the rotary joint can be mounted on the base part so as to be removable for washing or cleaning. During operation, i.e. as long as polishing agent is continuously supplied or continuously circulates, hardening of the same is impossible. If the device is at a standstill, however, i.e. without continuous circulation of polishing agent, said polishing agent will inevitably dry up and consequently harden. A polishing device designed in this way can be manipulated much easier if the rotary joint is removable. Removable as used herein means that the rotary joint can be removed and mounted easily and quickly, either manually or even by machine, thanks to simple snap-on means and/or clamping means.

It can be particularly important for the present invention if the rotary joint has a front edge, relative to the direction of the axis of rotation D, and the ball-and-socket joint has a centre point M, and a distance b is provided between said front edge and said centre point M, relative to the direction of the axis of rotation D, which distance b is max. 25 mm or between 5 mm and 20 mm or 11 mm. As mentioned, it is important that the polishing plate holder is not spaced apart from the centre point of the ball-and-socket joint more than really necessary. If the rotary joint acts as the polishing head holder, the aforesaid distance b should not be exceeded. As the distance b increases, restoring torques will result during machining which negatively affect the dynamic adaptation of the base part with the polishing plate attached thereto to the geometry or inclination of the partial surface to be machined.

In the context of the inventive design and arrangement, it can be advantageous if a polishing plate is mounted such that the rotary joint is arranged between the base part and said polishing plate. In use, i.e. when the polishing plate is push-fitted, a rotary joint which is placed in this way ensures optimum supply of polishing agent to or into the polishing plate for transfer into the area between a polishing film and the surface to be machined.

Furthermore, it can be advantageous if the outlet opening of the polishing agent channel system is arranged between the base part and the polishing plate. The outlet opening is preferably located between the ball-and-socket joint and the polishing plate because the ball-and-socket joint is arranged centrally and the polishing agent should preferably be delivered centrally into the polishing plate. Said central delivery ensures that the polishing agent will be distributed in the radial direction due to the rotation of the polishing plate during operation thereof.

In addition, it can be advantageous if the polishing plate comprises a polishing pad, and a distance a is provided between the centre point M of the ball-and-socket joint and said polishing pad, relative to the direction of the axis of rotation D, which distance a is max. 40 mm or between 10 mm and 30 mm or 25 mm. The polishing plate is usually formed of a carrier, a flexible or elastic carrier layer which is arranged on said carrier and a polishing pad which is arranged on said carrier layer. The distance a between the centre point M of the ball-and-socket joint and the polishing pad varies, depending on the thickness of the carrier layer. As explained above, a too great distance a negatively affects the dynamic tiltability of the polishing plate or the adaptability of the polishing plate to the angular position of the surface to be polished in case of dynamic machining thereof.

Furthermore, it can be advantageous if the rotary joint or the base part is designed as a coupling part for the polishing plate or comprises at least one coupling element for the polishing plate. The polishing plate is preferably push-fitted or clipped on so that it can be changed by machine. A clip-on connection is sufficient for axially mounting the polishing plate because during machining, the base part or the spindle press said polishing plate against the surface to be machined. In contrast, the polishing plate requires sufficient form fit or force fit in the circumferential direction and in the radial direction so that the polishing movement or the polishing forces can be transmitted. In case of a form-fit connection, driving lugs are usually provided which fulfil the aforesaid conditions. There can, in principle, be a separation of functions as regards coupling of the polishing plate. The coupling element can be included either in the rotary joint or in the base part.

In this context, it can be advantageous if the rotary joint is connected to the base part so as to form a single piece. The design of the base part or the rotary joint would thus be somewhat simpler, whereas disassembly of the rotary joint for cleaning or washing would be a little more difficult.

Finally, it can be advantageous if the polishing spindle comprises an axial axis of translation T and a further rotary joint for gas. To adapt the base part or the polishing plate attached thereto to the varying height of the surface to be machined, the base part is usually pre-stressed pneumatically via the ball-and-socket joint, for which purpose a suitable gas pressure is supplied by means of the further rotary joint.

The provision of a coupling element by means of which the rotary joint can be detachably push-fitted or clipped onto a polishing spindle enables an easy change for cleaning and/or exchange purposes. In addition, it should be ensured that the rotary joint is axially secured on the one hand and that force for rotational and translational driving by the spindle or the base part is transmitted due to form fit and/or force fit on the other.

For this purpose, it can be advantageous if at least one coupling part for detachably push-fitting or clipping on a polishing plate is provided. As the rotary joint can be placed on or push-fitted or clipped onto the base part according to the invention, it is advantageous to attach the polishing plate to the rotary joint via a suitable coupling part. Said attachment is usually achieved by means of a clip-on or push-fit connection so that it can be detached easily and quickly, either manually or even by machine, to exchange the polishing plate if required. Said exchange can be done without disassembling any other spindle parts. Securing means which might be provided should be such that they can be manually detached or arrested easily and quickly.

If a polishing agent is supplied between the polishing plate and the lens during polishing via a rotary joint arranged between the polishing spindle and said polishing plate, the polishing performance and the polishing quality which can be achieved are improved. The polishing agent which is applied laterally of the polishing plate and incorporated during the polishing process should be sufficient in most cases.

BRIEF DESCRIPTION OF THE DRAWINGS

Further advantages and details of the invention are explained in the patent claims and in the description and shown in the figure.

FIG. 1 is a side elevational view in partial cross-section of a polishing device.

DETAILED DESCRIPTION OF THE INVENTION

A polishing device 1 as shown consists of a spindle 1.2 on the front end of which a base part 1.1 is provided which carries a rotary joint 3 on its front side. A polishing plate 2 can be placed on the rotary joint 3 or is placed thereon according to the illustration.

The polishing spindle 1.2 comprises a housing 1.7 which is connected to a drive (not shown) in order to be rotationally driven. Within the housing 1.7, an axially moveable piston 1.5 is mounted on the front side end of which a ball-and-socket joint 1.3 for tiltably receiving the base part 1.1 is provided. The piston 1.5 can be axially moved in the direction of an axis of translation T, for which purpose an axial force is exerted on said piston via a cylinder 1.8 which is connected to a further rotary joint 1.4 for gas. The rotational movement is transmitted via the housing 1.7 to bellows 1.6 which are connected to the base part 1.1 again in order to rotationally drive the latter. To ensure a defined spatial relation between the base part 1.1 and the piston 1.5 or the housing 1.7, said housing 1.7 comprises a stop and centring means 1.9 on its front side end with which the base part 1.1 can be brought in contact in the axial direction and/or the radial direction. Said axial contact is achieved by a corresponding downward movement of the piston 1.5 according to the illustration so that the base part 1.1 is in contact with the stop means 1.9 while the bellows 1.6 are compressed.

The rotary joint is essentially formed of a housing 3 which is placed on the front side of the base part 1.1 and secured by means of a securing means 3.9. The housing 3 rotates along with the base part 1.1. To ensure the rotary joint 3, a wall part 3.5 is provided which is supported on the housing 3 in a suitable recess and can be moved in the circumferential direction. The wall part 3.5 has a U-shaped cross section, thus forming a channel wall 3.5 of an annular channel 3.2 of the rotary joint 3. The wall part 3.5 does not carry out the rotational movement of the housing 3 and comprises a supply pipe 4 for a polishing agent. Within the housing 3, a first connection channel 3.4 and a second connection channel 3.4' are provided. The respective connection channel 3.4, 3.4' extends from the annular channel 3.2 to a front side end or an outlet opening 3.3 of the housing 3. The annular channel 3.2 forms a supply opening 3.2 for the polishing agent. The respective connection channel 3.4, 3.4' has a radial direction component Vr as well as an axial direction component Vd, relative to an axis of rotation D of the polishing spindle 1.2. The aforesaid direction components Vr, Vd are described using the front side portion of the respective connection channel 3.4, 3.4' as an example. In addition to the channel portion on the front side, the respective connection channel 3.4, 3.4' also has an adjacent channel portion on the side of the annular channel which also has a radial direction component Vr as well as an axial direction component Vd. The overall result is an inlet geometry of the polishing agent channel system 3.1 having a radial and an axial flow component, which facilitates a short construction.

The rotary joint 3 is coupled to the base part 1.1 by means of a coupling part 3.8.

The rotary joint 3 comprises several coupling elements 3.7 which are designed as annular beads and serve to push-fit or clip the polishing plate 2 thereon. The polishing plate 2 comprises a corresponding carrier 2.1 which can be placed on or push-fitted onto the aforesaid coupling elements 3.7 due to its geometry. On the carrier 2.1, a carrier layer 2.2 made of foam is arranged on the front side of which a polishing pad 2.3 is finally attached.

The polishing pad 2.3 as well as the carrier layer 2.2 and the carrier 2.1 comprise a recess which is coaxial to the axis of rotation D and through which the polishing agent exiting from the outlet opening 3.3 can be delivered against a surface to be polished.

The ball-and-socket joint 1.3 has a centre point M which is at a distance a to the polishing pad 2.3, relative to the direction of the axis of rotation D. A distance b is provided between the centre point M and a front edge 3.6 of the rotary joint 3. The difference between the distance a and the distance b essentially results from a height (not shown) of the carrier layer 2.2 of the polishing plate 2.

LIST OF REFERENCE NUMERALS

1 Polishing device
1.1 Base part
1.2 Polishing spindle
1.3 Ball-and-socket joint
1.4 Further rotary joint
1.5 Piston
1.6 Bellows
1.7 Housing
1.8 Cylinder
1.9 Stop and centring means
2 Polishing plate
2.1 Carrier
2.2 Carrier layer, foam part
2.3 Polishing pad
3 Rotary joint, housing
3.1 Polishing agent channel system
3.2 Supply opening, annular channel
3.3 Outlet opening
3.4 Connection channel
3.4' Connection channel
3.5 Wall part, channel wall
3.6 Front edge
3.7 Coupling element
3.8 Coupling part
3.9 Securing means
4 Supply pipe M Centre point
a Distance
b Distance
c Distance
D Axis of rotation
T Axis of translation
V Vector
Vd Direction component
Vr Direction component

What is claimed is:

1. A polishing device for polishing optical lenses, comprising: a tiltable base part for directly or indirectly receiving a polishing plate, wherein the base part is connected to a polishing spindle having an axis of rotation D in order to be rotationally driven, wherein a rotary joint for supplying a polishing agent is provided, wherein the rotary joint is at least partly arranged opposite the polishing spindle, relative to the direction of the axis of rotation D and relative to the base part.

2. The device according to claim 1, wherein the rotary joint comprises at least one polishing agent channel system having at least one supply opening and at least one outlet opening, wherein the outlet opening of the polishing agent channel system is at least partly arranged opposite the polishing spindle, relative to the base part.

3. The device according to claim 2, wherein the supply opening of the polishing agent channel system is designed as an annular channel comprising several connection channels which are separated from each other and wherein the respective connection channel connects the annular channel to the outlet opening.

4. The device according to claim 3, wherein the respective connection channel has a direction component Vd parallel to the axis of rotation D, wherein the respective connection channel is arranged at a distance c to said axis of rotation D, at least over a part of its length.

5. The device according to claim 2, wherein the rotary joint is mounted on the base part so as to be removable for washing or cleaning.

6. The device according to claim 1, wherein the rotary joint has a front edge, relative to the direction of the axis of rotation D, and a ball-and-socket joint has a centre point M, wherein a distance b is provided between said front edge and said centre point M, relative to the direction of the axis of rotation D, which distance b is max. 25 mm.

7. The device according to claim 1, wherein a polishing plate is mounted such that the rotary joint is arranged between the base part and said polishing plate, adjacent to said base part.

8. The device according to claim 5, wherein the outlet opening of the polishing agent channel system is arranged between the base part and the polishing plate.

9. The device according to claim 6, wherein, the polishing plate comprises a polishing pad, and a distance a is provided between the centre point M of the ball-and-socket joint and said polishing pad, relative to the direction of the axis of rotation D, which distance a is max. 40 mm.

10. The device according to claim 1, wherein the rotary joint or the base part is designed as a coupling part for the polishing plate or comprises at least one coupling element for the polishing plate.

11. The device according to claim 1, wherein the rotary joint is connected to the base part so as to form a single piece.

12. The device according to claim 1, wherein the polishing spindle comprises an axial axis of translation T and a further rotary joint for gas.

13. A polishing device for polishing optical lenses, comprising: a tiltable base part for directly or indirectly receiving a polishing plate, wherein the base part is connected to a polishing spindle having an axis of rotation D in order to be rotationally driven, wherein a rotary joint for supplying a polishing agent is provided, wherein the base part is arranged at least partly between the polishing spindle and the rotary joint.

* * * * *